US007838095B2

(12) United States Patent
Varma et al.

(10) Patent No.: US 7,838,095 B2
(45) **Date of Patent: *Nov. 23, 2010**

(54) CORRUGATED POLYMERIC VOID BOARD

(75) Inventors: Tilak R. Varma, Grayslake, IL (US); Lawrence Share, Skokie, IL (US); Lawrence R. Peck, Frankfort, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 776 days.

This patent is subject to a terminal disclaimer.

(21) Appl. No.: 11/156,331

(22) Filed: Jun. 17, 2005

(65) Prior Publication Data

US 2006/0283142 A1 Dec. 21, 2006

(51) Int. Cl.

| | |
|---|---|
| ***E06B 3/00*** | (2006.01) |
| ***B32B 3/30*** | (2006.01) |
| ***B65D 85/46*** | (2006.01) |
| ***A47F 7/00*** | (2006.01) |
| ***B32B 37/12*** | (2006.01) |

(52) U.S. Cl. ..... 428/43; 428/120; 428/166; 428/167; 428/188; 428/903.3; 414/931; 211/49.1; 211/59.4; 206/322; 156/292

(58) Field of Classification Search ..... 428/43, 428/119, 120, 166, 167, 172, 188, 903.3; 206/322; 211/49.1, 59.4; 248/346.01, 634; 414/798.2, 931; 156/244.15, 290, 292

See application file for complete search history.

(56) References Cited

U.S. PATENT DOCUMENTS

| | | | | |
|---|---|---|---|---|
| 2,869,721 | A | 1/1959 | Baumer | |
| 2,962,163 | A | 11/1960 | Else | |
| 3,189,175 | A | 6/1965 | Cruckshank | |
| 3,274,315 | A * | 9/1966 | Kawamura | 264/563 |
| 3,509,005 | A * | 4/1970 | Hartig | 428/34.2 |
| 3,685,229 | A | 8/1972 | Sale et al. | |
| 3,919,379 | A | 11/1975 | Smarook | |
| 4,035,539 | A | 7/1977 | Luboshez | |
| 4,245,013 | A | 1/1981 | Clegg et al. | |
| 4,465,729 | A | 8/1984 | Cancio et al. | |
| 4,536,362 | A | 8/1985 | Donaldson | |

(Continued)

FOREIGN PATENT DOCUMENTS

| | | |
|---|---|---|
| NL | 6602815 | 9/1967 |

(Continued)

OTHER PUBLICATIONS

German Search Report for GB0504862.4 dated Jun. 7, 2005.

(Continued)

*Primary Examiner*—Donald Loney
(74) *Attorney, Agent, or Firm*—Levenfeld Pearlstein, LLC

(57) ABSTRACT

A polymeric void-board is placed between adjacent horizontal layers of bricks to maintain an opening in a lower of the layers. The void-board is fabricated from a first relatively thin planar element having first and second surfaces having a plurality of parallel ribs extending from and generally transverse to the first surface and a second relatively thin planar element having first and second surfaces having a plurality of parallel ribs extending from and generally transverse to the first surface. The first and second elements are joined to one another with the ribs of the first element engaging and joined to the second element.

15 Claims, 1 Drawing Sheet

U.S. PATENT DOCUMENTS 4,788,777 A * 12/1988 Davis ..... 34/239
5,310,593 A * 5/1994 Tsujimoto et al. ..... 428/166
5,783,286 A * 7/1998 DiNicola ..... 428/188
5,946,878 A 9/1999 Grund et al.
5,965,238 A * 10/1999 Saitoh et al. ..... 428/178
6,623,838 B1 * 9/2003 Nomura et al. ..... 428/167
6,827,179 B2 12/2004 Drake et al.
6,989,184 B2 1/2006 Duke et al.

FOREIGN PATENT DOCUMENTS

WO WO2007055662 5/2007

OTHER PUBLICATIONS

International Search Report for PCT/US08/64499 dated Aug. 15, 2008.

* cited by examiner

CORRUGATED POLYMERIC VOID BOARD

BACKGROUND OF THE INVENTION

The present invention relates generally to a polymeric board used as a void-board. More particularly, the present invention relates to a fabricated, corrugated void-board for use in forming bundles of bricks.

Bricks are typically bundled as a plurality of stacked individual units (i.e., individual bricks) formed into a 3-dimensional bundle. The bundle includes one or more package straps, corner protectors, and a void-board, that is placed between two horizontal layers of bricks. Generally, the void-board is placed above a layer of bricks that has bricks not present, e.g., forming two holes in the bundle. Additional layers of bricks are placed on top of the board. The holes, which are typically centrally disposed, are configured to allow the prongs of a forklift or similar device to pass into the bundle. In moving the package of bricks, the forklift exerts a force on the underside of the board, to lift the entire package. Typically, the holes are formed extending through the entire depth of the bundle.

One known void-board is formed as a veneer. These veneer void-boards are often of poor quality and have a tendency to warp. Warping results in uneven surfaces upon which layers of bricks are stacked, which in turn can result in package instability. Moreover, veneer void-boards do not allow clean "separation" of the brick layers (in the depth direction) from the bundle, in that there is no easy way to separate the bricks and sever or cut the board at the juncture of that layer and the remainder of the brick bundle.

Another void board uses a solid or ribbed plastic sheet. Such a void board is disclosed in Duke et al., U.S. patent application Ser. No. 10/803,398, now U.S. Pat. No. 6,989,184 commonly assigned with the present application and incorporated herein by reference. While this void board has been found to function well at a given thickness, it requires a higher material weight (and thus cost) than desired for such a consumable item. When a thinner sheet is used (and thus less material), it has been found that the board may not have the desired stiffness.

Accordingly, there is a need for a void-board that is of consistent quality, consistency and strength to allow stable stacking of bricks for bundle forming without crushing the board. Desirably, such a void-board is readily severed for separating layers of bricks. More desirably, such a void-board endures environmental conditions without warping. Most desirably, such a void board is fabricated or manufactured such that a lesser weight of material is used to provide a sufficiently stiff board.

SUMMARY OF THE INVENTION

A polymeric void-board is configured for placement between adjacent horizontal layers of bricks to maintain an opening in a lower layer of the bricks. The opening is configured for insertion of a prong of a forklift for transporting the bundle of bricks.

The void-board is fabricated from a first relatively thin planar element having first and second surfaces having a plurality of parallel ribs extending from and generally transverse to the first surface and a second relatively thin planar element having first and second surfaces having a plurality of parallel ribs extending from and generally transverse to the first surface. The first and second elements are joined to one another with the ribs of the first element engaging and joined to the second element.

In one embodiment, the ribs of the first element are engaging and joined to the second element at the first surface. That is, the elements are joined with the ribs of the first element joined to the opposite or flat surface of the second element in a front-to-back configuration.

Alternately, the ribs of the first element are engaging and joined to the ribs of the second element in a front-to-front (or rib-to-rib) configuration. In both configurations, the ribs of the first and second elements are parallel to one another.

The elements are joined to one another to define void spaces between the ribs and the opposing element. This reduces the amount of material needed to fabricate the void-board.

Optionally, the void-board can be fabricated with weakened regions formed in the first and second elements generally parallel to the ribs and aligned with one another. This provides a plurality of frangible regions for separating the board.

The board can be configured with the ribs at on center distance of about 0.10 inches to about 0.50 inches, and preferably about 0.14 inches.

The board can be formed from a polyolefin blend. The polyolefin can be polyethylene and/or polypropylene (and can be from, for example, recycled diapers) and can include a blend with a filler material, such as a cellulose fiber material or a thermoplastic elastomer material. The board can be formed from recycled materials, such as recycled diapers.

A method of making a polymeric void-board includes the steps of forming a first relatively thin planar element having first and second surfaces having a plurality of parallel ribs extending from and generally transverse to the first surface, a forming a second relatively thin planar element having first and second surfaces having a plurality of parallel ribs extending from and generally transverse to the first surface and joining the first and second planar elements to one another with the ribs of the first element engaging and joined to the second element.

The first and second elements can be welded to one another or joined by adhesive, and can be joined in a rib-to-rib configuration or a rib-to-back configuration.

These and other features and advantages of the present invention will be readily apparent from the following detailed description, in conjunction with the claims.

BRIEF DESCRIPTION OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
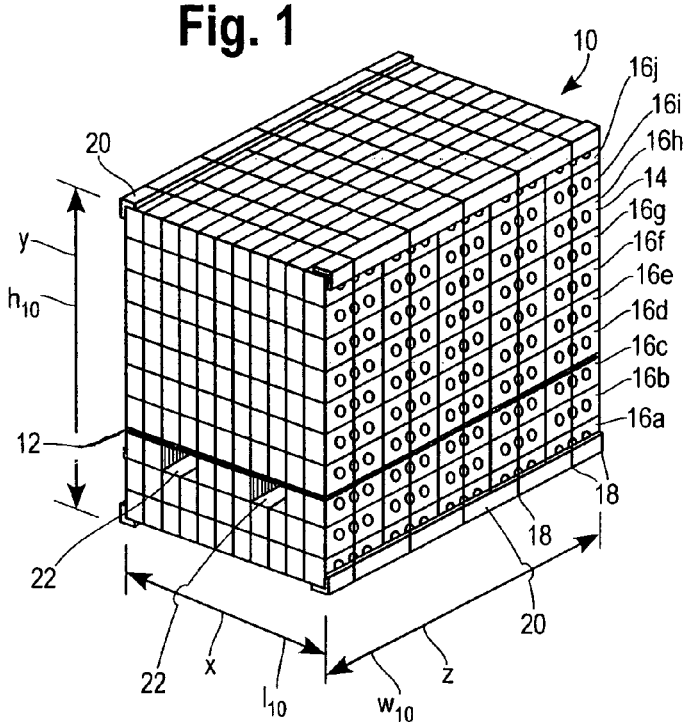
FIG. 1 is a perspective view of a bundle of bricks having a void-board embodying the principles of the present invention disposed between horizontal layers of bricks.

While the present invention is susceptible of embodiments in various forms, there is shown in the drawings and will hereinafter be described some exemplary and non-limiting embodiments, with the understanding that the present disclosure is to be considered an exemplification of the invention and is not intended to limit the invention to the specific embodiments illustrated.

It should be understood that the title of this section of this specification, namely, "Detailed Description Of The Invention", relates to a requirement of the United States Patent Office, and does not imply, nor should be inferred to limit the subject matter disclosed herein.

With reference now to the figures and in particular to FIG. 1, a bundle 10 of bricks is shown with a one embodiment of a void-board 12 in accordance with the principles of the present invention. The bundle 10 is a 3-dimensional stack of individual bricks 14 that form a matrix with a plurality of horizontal layers, e.g., 16*a*-16*j*. The stack 10 thus defines a length $l_{10}$, a height $h_{10}$ and a width $w_{10}$, which are represented by the x, y and z-axes as shown.

The bundle is maintained in the 3-dimensional configuration by straps 18 that are positioned about the bundle 10. In a typical bundle 10, vertical straps (in the y-direction) are positioned around the bundle 10 extending in both the x and z-directions. Horizontal straps can be, but generally are not used. Corner protectors 20 are disposed along the corners of the brick bundle 10 between the bricks 14 and strap 18 to protect the bricks 14 from damage due to rubbing and accidental bumping. The corner protectors 20 also preclude strap 18 failure due to, for example, abrasion.

In order to readily transport the bundle 10, openings 22 are formed in the bundle 10 by removing or eliminating bricks in a predetermined area of the matrix. The openings 22 are configured to permit the insertion of the prongs of a forklift. In this manner, the prongs can be inserted into the openings 22 and the bundle 10 raised and transported as desired.

Figure 3A:
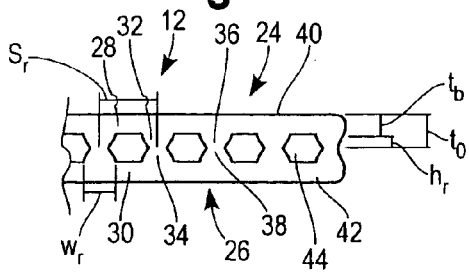
FIG. 3A is an enlarged view, as indicated in FIG. 3, illustrating the rib and board end profile.
Figure 3:
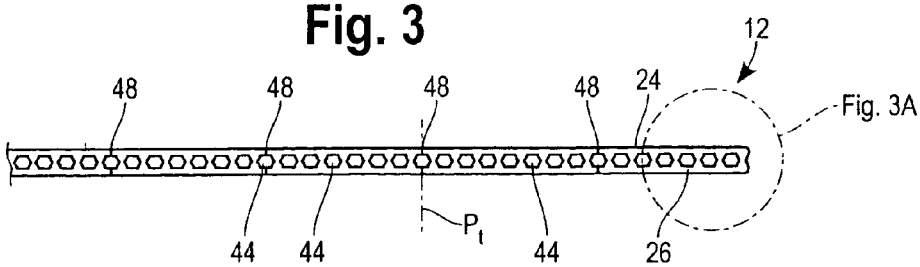
FIG. 3 is a side view of one embodiment of the void-board of the present invention.

To maintain the layer 16*d* of bricks 14 above the opening 22, the void-board 12 is placed between the horizontal layers 16*c* and 16*d* of bricks 14, that is, above the layer 16*c* in which the openings 22 are formed. One embodiment of the void-board 12 is illustrated in FIGS. 3 and 3A, which show a profile of the board 12. The board 12 is fabricated as a single wall corrugated member having first and second board elements 24, 26. Each of the elements 24, 26 includes a planar base element 28, 30 each having a thickness $t_b$ of about 0.20 inches to about 0.80 inches and preferably about 0.30 inches to about 0.50 inches. A plurality of ribs 32, 34 extend outwardly from each planar element 28, 30 to a height $h_r$ of about 0.20 inches to about 0.80 inches and preferably about 0.30 inches to about 0.50 inches. In a present board 12, the ribs 32, 34 are parallel and are generally equal in height (or distance from their respective planar base element 28, 30).

To form the corrugated configuration, the pair of board elements 24, 26 are joined to one another. As seen in FIGS. 3 and 3A, in a first embodiment, the elements 24, 26 are joined to one another in a front-to-front or peak-to-peak facing configuration. That is, the peaks 36 of the ribs 32 of one board 24 are joined to the peaks 38 of the ribs 34 of the facing board 26. This produces a pair of board elements 24, 26 spaced from one another by the joined ribs 32, 34. This configuration of the board 12 produces an apparently thick sheet that has a plurality of interior ribs 32, 34 connecting the sheets 24, 26, with flat outer faces 40, 42. The spaces 44 between the ribs 32, 34 provide a plurality of void spaces 44.

Figure 4:
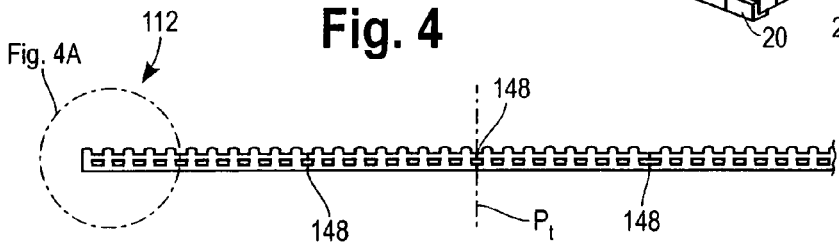
FIG. 4 is a side view of an alternate embodiment of the void-board.
Figure 4A:
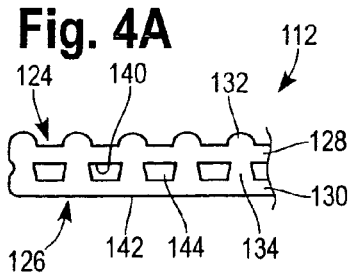
FIG. 4A is an enlarged view of the board of FIG. 4, illustrating the rib and board profile.

An alternate embodiment of the void-board 112 is illustrated in FIGS. 4 and 4A. In this embodiment, the board elements 124, 126 are joined in a front-to-back or in a peak-to-board configuration. Thus, the board 112 appears as a double-stacked ribbed sheet. This configuration of the board 112 produces an apparent thick ribbed sheet that has a plurality of interior ribs 134 connecting the "lower" board element 126 with the "upper" board element 124 which has exposed ribs 132. The spaces defined by the ribs 134 of the "lower" element 126 and the face 140 of the "upper" element 124 provide a plurality of void spaces 144. The ribs 134 are joined to the face 140 of element 124 and the face 142 of element 126 is the apparent "back" of the board 112.

Advantageously, in both embodiments 12, 112, the strength of the board is preserved even with less material used to fabricate the sheet. This is accomplished by providing joined structural shapes to define the board.

In a present embodiment, the board elements 24, 26, 124, 126 are joined or bonded to one another by welding, application of adhesives, extrusion laminating or other processes that will be recognized by those skilled in the art. A preferred method of fabricating the corrugated void board is to use ultrasonic welding in, for example, a continuous process in which two sheets in roll form are brought together using a guide roll to create the corrugated structure. In such a method, a patterned roll (which is a mirror image of the groove pattern—the compliment of the rib pattern—in the ribbed portion of the extruded sheet), is use to guide the sheet onto an ultrasonic anvil (not shown).

In a present embodiment, each of the board elements 24, 26, 124, 126 has an overall thickness $t_o$ (including the thickness of the base element and the height of the ribs) of about 0.40 inches to about 0.80 inches, and most preferably about 0.55 inches. The ribs 32, 34, 132, 134 have a width $w_r$ of about 0.20 inches to about 0.60 inches and preferably about 0.25 inches to about 0.35 inches and are spaced $s_r$ from adjacent ribs about 0.10 inches to about 0.50 inches and preferably about 0.10 inches to about 0.30 inches on center.

Optionally, the void-board 12, 112 can be formed having one or more weakened regions 48, 148 formed in the planar bases 28, 30, 128, 130. The weakened regions 48, 148 can be made by forming a score, crease or perforation in the respective bases 28, 30, 128, 130. The weakened regions 48, 148 extend parallel to and between the ribs 32, 34, 132, 134. The weakened regions 48, 148 of the upper and lower elements 24, 26, 124, 126 are in the same transverse plane $p_t$ as one another and permit separating the board 12, 112 (cleanly along a "corrugation" or between aligned ribs 32, 34, 132, 134 and within the same void spaces 44, 144) after, for example, the bricks forming a vertical layer 50 of the bundle 10 (see FIG. 2) are removed. In this manner, the remaining board is not extending out beyond the bundle 10 as would be with a solid sheet.

The board 12, 112 can be formed from a wide variety of readily available materials. A present board 12, 112 is made from a low melt-strength, inexpensive polymeric material. It is anticipated that recycled diapers (polyolefin blends with various fibrous or particulate filler materials) can be used as the material for the void-board 12, 112. Polypropylene (PP), linear low density polyethylene (LLDPE), and a filler material such as cellulose fibers or a thermoplastic elastomer material can be used.

Each of the board elements 24, 26, 124, 126 is, preferably, an extruded member. The board elements are typically formed having a density of about 0.7 grams per cubic centimeter (gm/cc) to about and 1.3 gm/cc, preferably about 0.85 gm/cc to about 1.15 gm/cc and most preferably about 1 gm/cc. It should be noted that 1 gm/cc is equal to a specific gravity of about 1.0. It is contemplated that the ribs 32, 34, 132, 134 are formed in the machine direction of the elements

24, 26, 124, 126, e.g., as the element is extruded, to facilitate manufacture. Such manufacture also results in a high strength board 12, 112.

Figure 2:
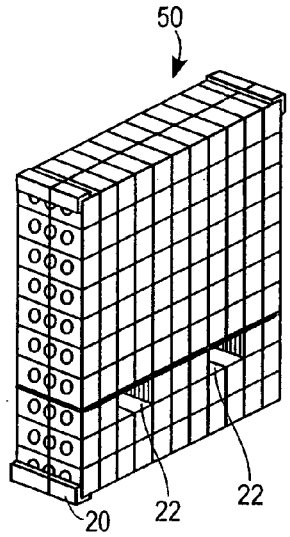
FIG. 2 is a perspective view of one vertical layer of bricks separated from the bundle of FIG. 1.

In addition to the enhanced stability and reduced "crush" afforded by the present void-board 12, 112, an additional the benefit of the present board is the ability to remove a vertical brick layer 50 (removed perpendicular to the direction of the fork prong openings 22 as seen in FIG. 2), and to retain the board 12,112, in a clean-cut condition by separating along one of the weakened regions 48, 148 to maintain the integrity of the remainder of the brick bundle 10.

In the disclosure, the use of the disjunctive is intended to include the conjunctive. The use of the definite article or indefinite article is not intended to indicate cardinality. In particular, a reference to "the" object or "a" object is intended to denote also one of a possible plurality of such objects.

All patents referred to herein, are hereby incorporated herein by reference, whether or not specifically done so within the text of this disclosure.

From the foregoing it will be observed that numerous modification and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A polymeric void-board for placement between adjacent horizontal layers of bricks to maintain an opening in a lower of the layers, the void-board comprising:

a first relatively thin rigid planar element having first and second surfaces having a plurality of parallel ribs extending from and generally transverse to the first surface; and a second relatively thin rigid planar element having first and second surfaces having a plurality of parallel ribs extending from and generally transverse to the first surface, wherein the first element and the second element each have a density of between approximately 0.7 gm/cc and 1.3 gm/cc, and wherein the first and second elements are joined to one another with the ribs of the first element engaging and joined to the second element, the ribs of the first element are parallel and joined to the ribs of the second element, spaces being defined between adjacent ribs of the first element and the second element, the spaces being void spaces and including weakened regions formed in the first and second elements generally parallel to the ribs and aligned with one another between selected ones of the ribs so as to provide a plurality of frangible regions for separating the board.

2. The polymeric void-board in accordance with claim 1 wherein an on center distance between the ribs of the first and second element is about 0.10 inches to about 0.20 inches.

3. The polymeric void-board in accordance with claim 2 wherein the on center distance is about 0.14 inches.

4. The polymeric void-board in accordance with claim 1 wherein the void-board is formed from a polyolefin blend.

5. The polymeric void-board in accordance with claim 4 wherein the polyolefin is blended with a filler material.

6. The polymeric void-board in accordance with claim 4 wherein the polyolefin is polypropylene or polyethylene.

7. The polymeric void-board in accordance with claim 5 wherein the filler material is a cellulose fiber material.

8. The polymeric void-board in accordance with claim 5 wherein the filler material is a thermoplastic elastomer material.

9. The polymeric void-board in accordance with claim 4 wherein the polyolefin blend is, in part, recycled material.

10. The polymeric void-board in accordance with claim 9 wherein the recycled material is recycled diapers.

11. A method of making a polymeric void-board comprising the steps of:

forming first rigid relatively thin planar element having first and second surfaces having a plurality of parallel ribs, extending from and generally transverse to the first surface;

forming a second rigid relatively thin planar element having first and second surfaces having a plurality of parallel ribs extending from and generally transverse to the first surface, wherein the first and second relatively thin planar elements each have a density between approximately 0.7 gm/cc and 1.3 gm/cc, the ribs of the first element being parallel and joined to the ribs of the second element, spaces being defined between adjacent ribs of the first element and the second element, the spaces being void spaces and including weakened regions formed in the first and second elements generally parallel to the ribs and aligned with one another between selected ones of the ribs so as to provide a plurality of frangible regions for separating the board.

12. The method in accordance with claim 11 wherein the first and second elements are joined to one another in a substantially continuous process brought together by a patterned guide roll to position the ribs of the first and second elements in contact with one another.

13. The method in accordance with claim 11 wherein the first and second elements are joined to one another by an adhesive.

14. The method in accordance with claim 11 wherein the first and second elements are formed, at least in part, from recycled materials.

15. The method in accordance with claim 14 wherein the recycled materials are recycled diapers.

* * * * *

UNITED STATES PATENT AND TRADEMARK OFFICE

CERTIFICATE OF CORRECTION

PATENT NO. : 7,838,095 B2
APPLICATION NO. : 11/156331
DATED : November 23, 2010
INVENTOR(S) : Tilak R. Varma et al.

It is certified that error appears in the above-identified patent and that said Letters Patent is hereby corrected as shown below:

Column 2, Line 31: The article "a" following the word "surface" should be removed.

Signed and Sealed this
Twenty-second Day of February, 2011

David J. Kappos

David J. Kappos
*Director of the United States Patent and Trademark Office*